US007062997B2

(12) United States Patent
Hu

(10) Patent No.: US 7,062,997 B2
(45) Date of Patent: Jun. 20, 2006

(54) PROTECTIVE SLEEVE FOR USE WITH EXTENSION BAR

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 57 days.

(21) Appl. No.: 10/814,566

(22) Filed: Mar. 31, 2004

(65) Prior Publication Data

US 2005/0016331 A1 Jan. 27, 2005

(30) Foreign Application Priority Data

Jul. 21, 2003 (TW) ..... 92119782 A

(51) Int. Cl.
*B25B 23/16* (2006.01)
*B25G 1/00* (2006.01)

(52) U.S. Cl. ..... 81/177.2; 81/177.85; 81/177.3; 81/180.1

(58) Field of Classification Search ..... 81/177.85, 81/177.2, 177.3, 180.1, 184; 403/109.2, 403/322.2; 24/573.11; 285/304
See application file for complete search history.

(56) References Cited

U.S. PATENT DOCUMENTS

| | | | | |
|---|---|---|---|---|
| 5,090,275 | A * | 2/1992 | McCann | 81/177.85 |
| 6,199,457 | B1 * | 3/2001 | Hoff et al. | 81/177.85 |
| 6,336,382 | B1 * | 1/2002 | Cerda | 81/60 |
| 6,792,836 | B1 * | 9/2004 | Wang | 81/177.85 |
| 2004/0089116 | A1 * | 5/2004 | Cheng | 81/177.85 |
| 2004/0126182 | A1 * | 7/2004 | Lin | 403/322.2 |

* cited by examiner

*Primary Examiner*—Joseph J. Hail, III
*Assistant Examiner*—Bryan Muller
(74) *Attorney, Agent, or Firm*—Alan D. Kamrath; Nikolai & Mersereau, P.A.

(57) ABSTRACT

A protective sleeve is provided for use with an extension bar. The extension bar includes a detent and a button that can be pressed in order to control the detent. The protective sleeve defines a hole and an aperture communicating with the hole. The hole receives the extension bar when the aperture receives the button.

1 Claim, 7 Drawing Sheets

PROTECTIVE SLEEVE FOR USE WITH EXTENSION BAR

FIELD OF INVENTION

The present invention relates to a protective sleeve for use with an extension bar.

BACKGROUND OF INVENTION

An extension bar 1 includes a shank 2 and a square insert 6 projecting from the shank 2. A button 3 is put in the shank 2. A portion of the button 3 extends from the shank 2. A detent 4 is embedded in the square insert 6. A portion of the detent 4 extends from the square insert 6. A mechanism (not shown) is arranged between the button 3 and the detent 4 so that when the button 3 is pushed, the detent 4 is allowed to completely enter the square insert 6. Therefore, a user will have his or her fingers hurt by the button 3 if the extension bar 1 is accidentally rotated before the user takes his or her hand 5 off the extension bar 1.

The present invention is therefore intended to obviate or at least alleviate the problems encountered in the prior art.

SUMMARY OF INVENTION

The primary objective of the present invention is to protect the hands of a user when using an extension bar.

According to the present invention, a protective sleeve is provided for use with an extension bar. The extension bar includes a detent and a button that can be pressed in order to control the detent. The protective sleeve defines a hole and an aperture communicated with the hole. The hole receives the extension bar when the aperture receives the button.

Other objectives, advantages, and novel features of the invention will become more apparent from the following detailed description when taken in conjunction with the attached drawings.

BRIEF DESCRIPTION OF DRAWINGS

The present invention will be described through detailed illustration of the preferred embodiment referring to the attached drawings.

DETAILED DESCRIPTION OF PREFERRED EMBODIMENT

Figure 1:
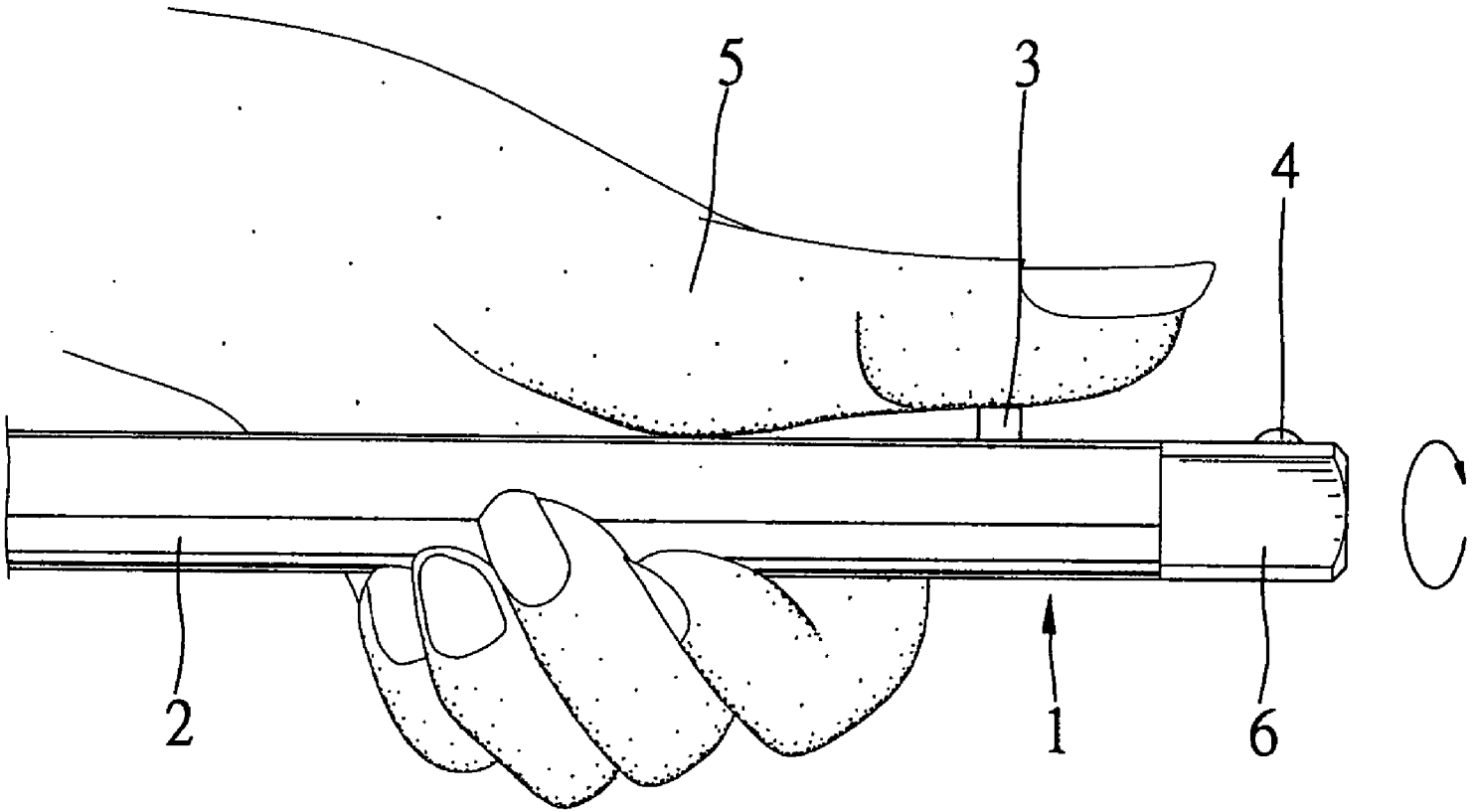
Fig. 1 PRIOR ART
FIG. 1 is a side view of a conventional extension bar.
Figure 2:
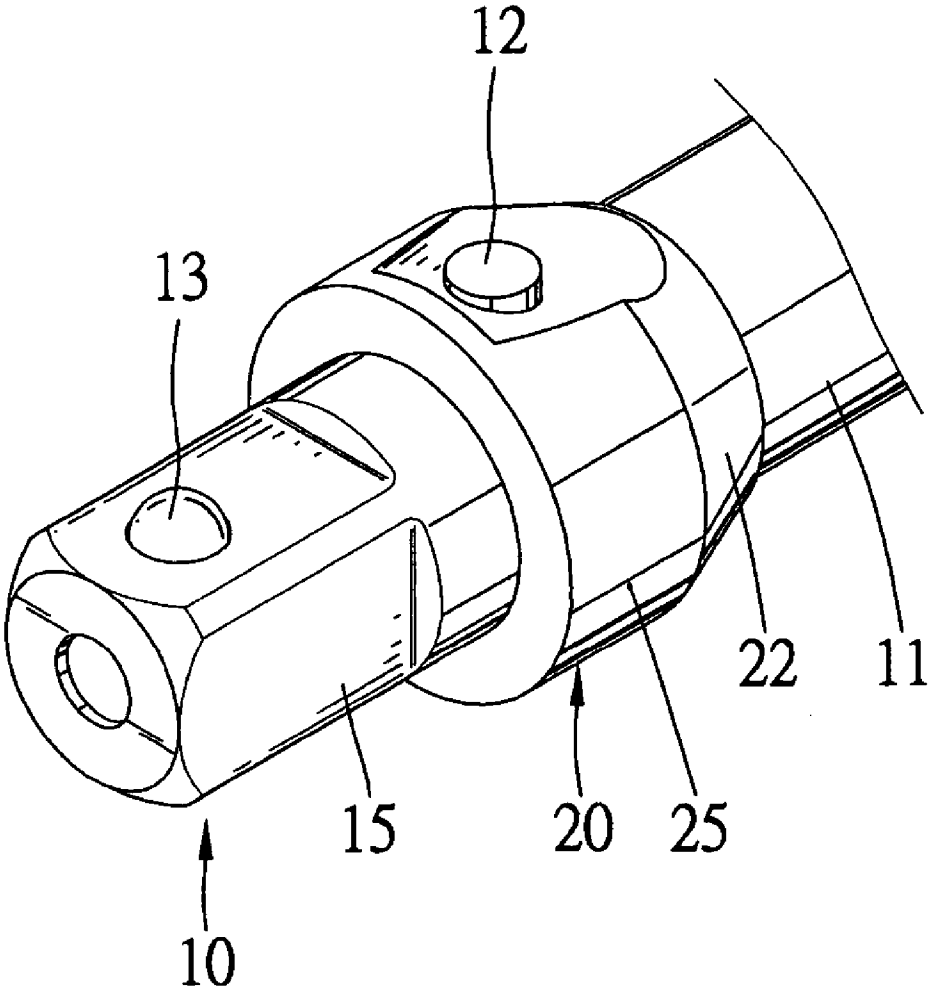
FIG. 2 is a perspective view of an extension bar with a protective sleeve according to the preferred embodiment of the present invention.
Figure 3:
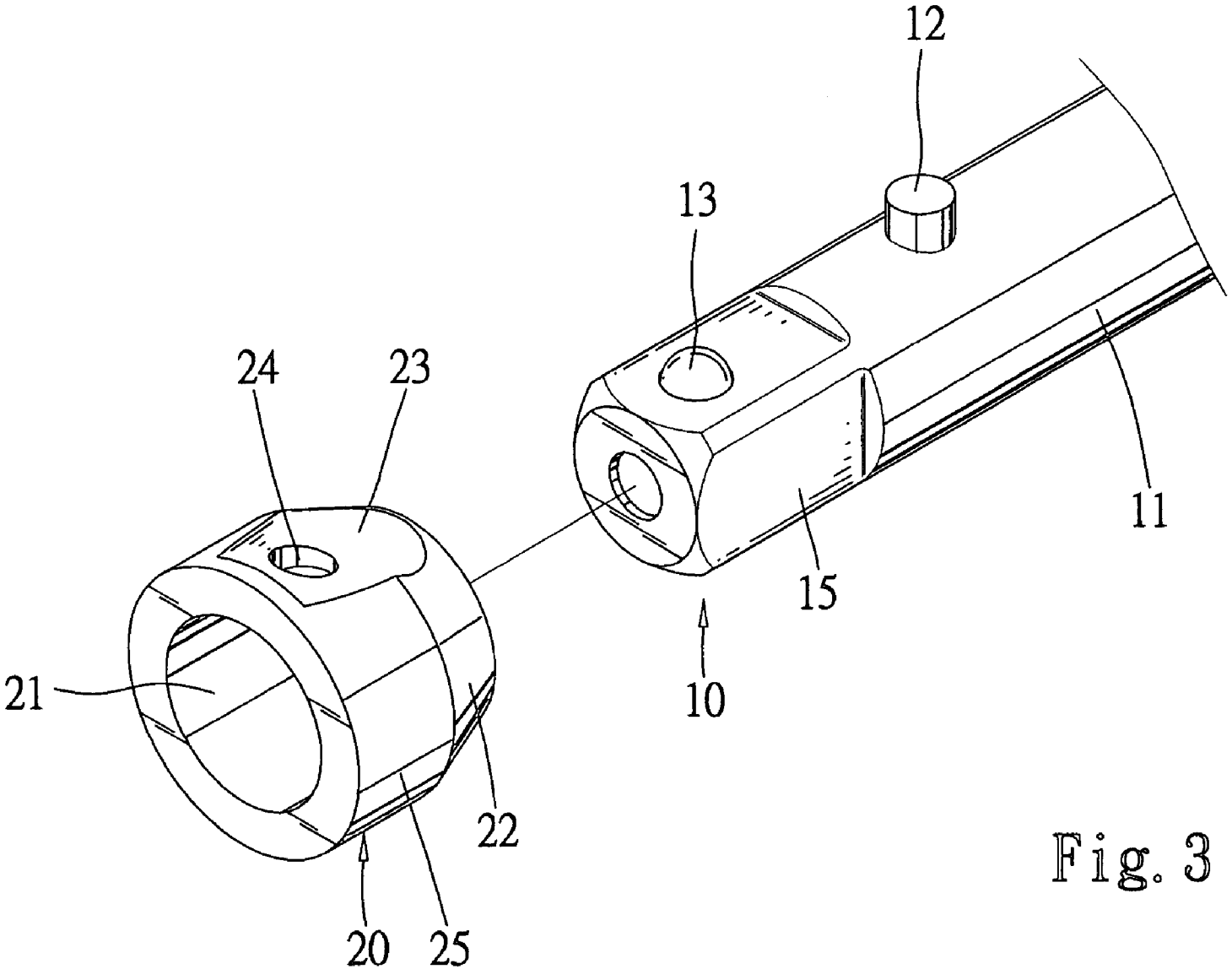
FIG. 3 is similar to FIG. 2 but shows the protective sleeve removed from the extension bar.

Referring to FIGS. 2 and 3, an extension bar 10 and a protective sleeve 20 are shown. The extension bar 10 includes a shank 11 and a square insert 15 projecting from the shank 11. A button 12 includes a first portion extending into the shank 11 and a second portion normally extending from the shank 11. The square insert 15 includes four facets formed thereon. A detent 13 includes a first portion put in one of the facets and a second portion normally extending from that facet unless pressed. The square insert 15 can be inserted into a square hole defined in a socket (not shown). How the button 12 cooperates with the detent 13 is well known and will not be described in detail.

The protective sleeve 20 includes a hole 21 defined in an axial direction so that the shank 11 can go through the hole 21 so that the protective sleeve 20 can be attached to the extension bar 10. The periphery of the protective sleeve 20 consists of a cylindrical portion 25, and a frustum-shaped portion 22 connects smoothly with the periphery of the shank 11. The protective sleeve 20 includes a recess 23 defined in the periphery. Within the recess 23, the protective sleeve 20 includes an aperture 24 communicating with the hole 21. The aperture 24 is used for receiving the button 12.

Figure 4:
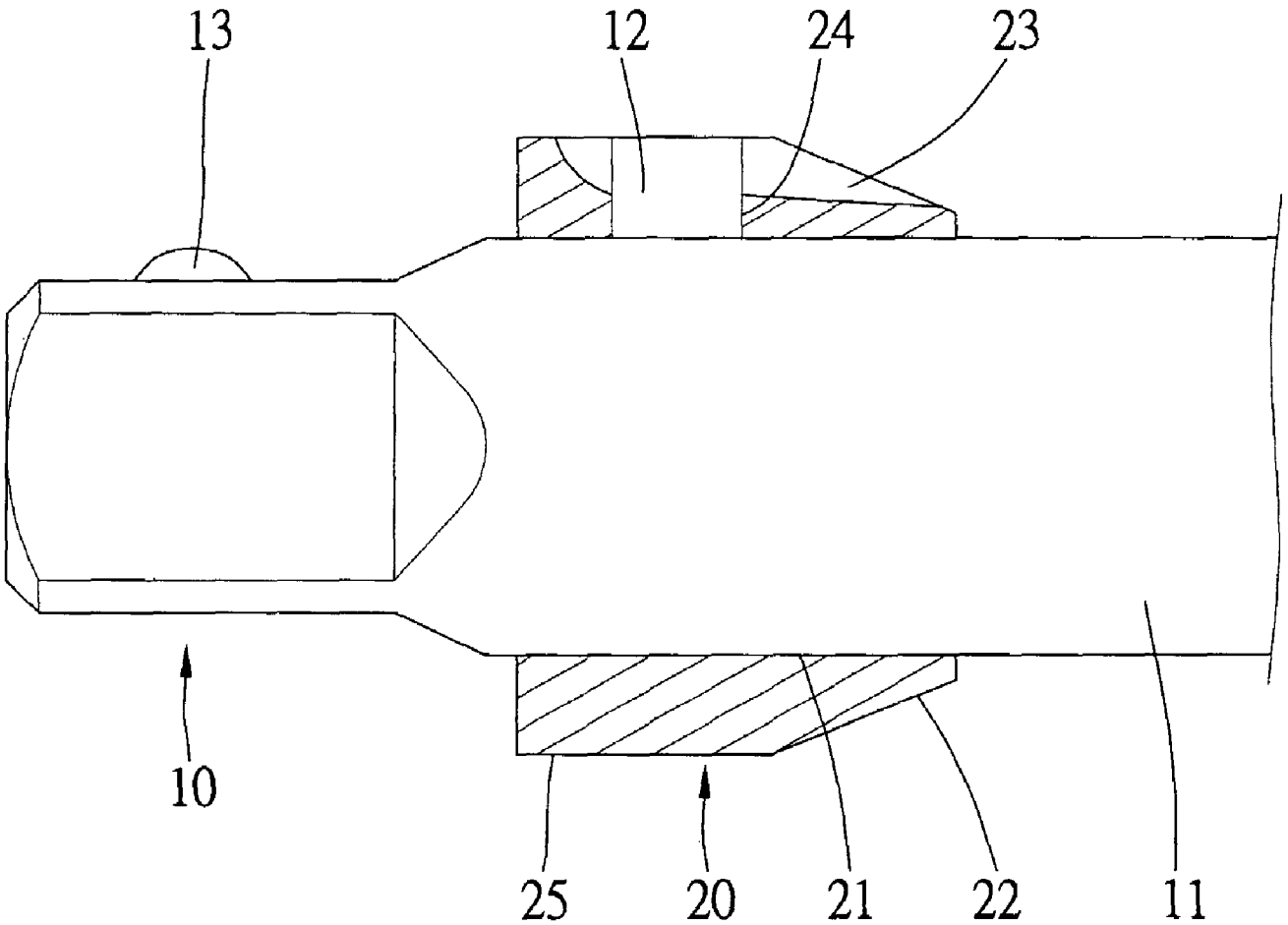
FIG. 4 is a cross-sectional view of the protective sleeve of FIG. 2.
Figure 5:
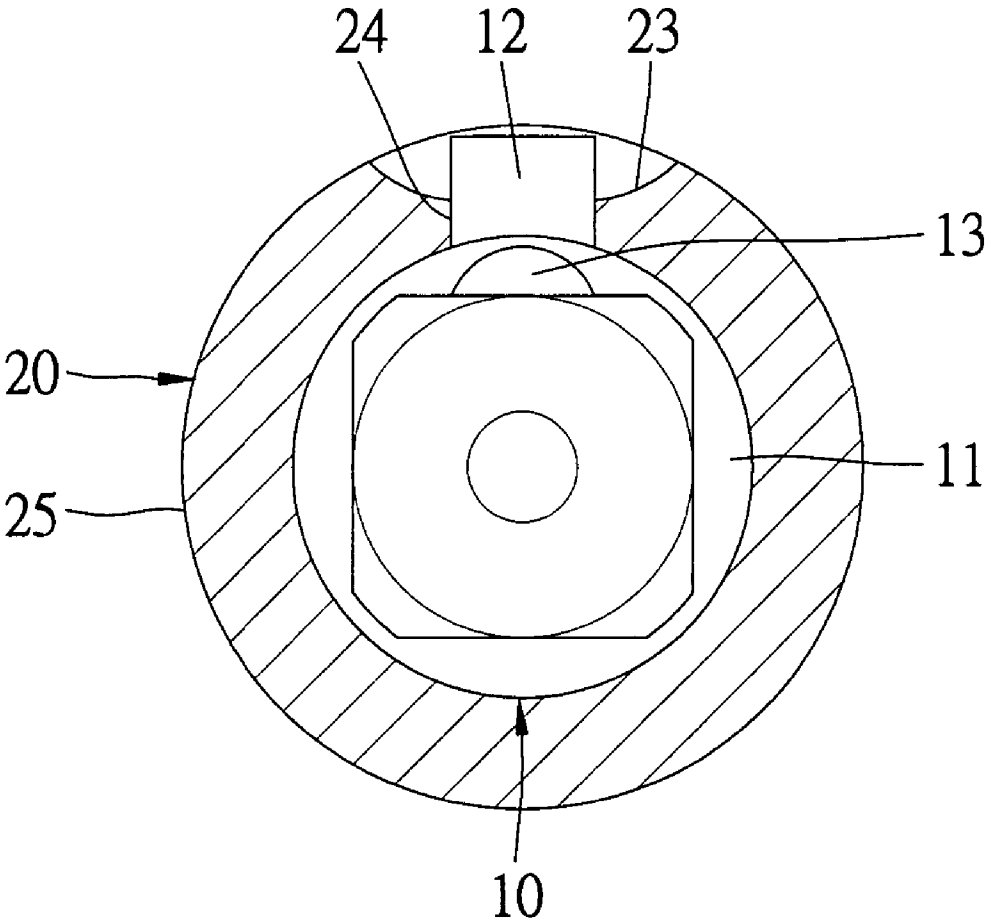
FIG. 5 is another cross-sectional view of the protective sleeve shown in FIG. 2.

Referring to FIGS. 4 and 5, the recess 23 encompasses the button 12. A height of the second portion of the button 12 is no greater than a thickness of the protective sleeve 20. Therefore, the button 12 does not protrude beyond the protective sleeve 20.

Figure 6:
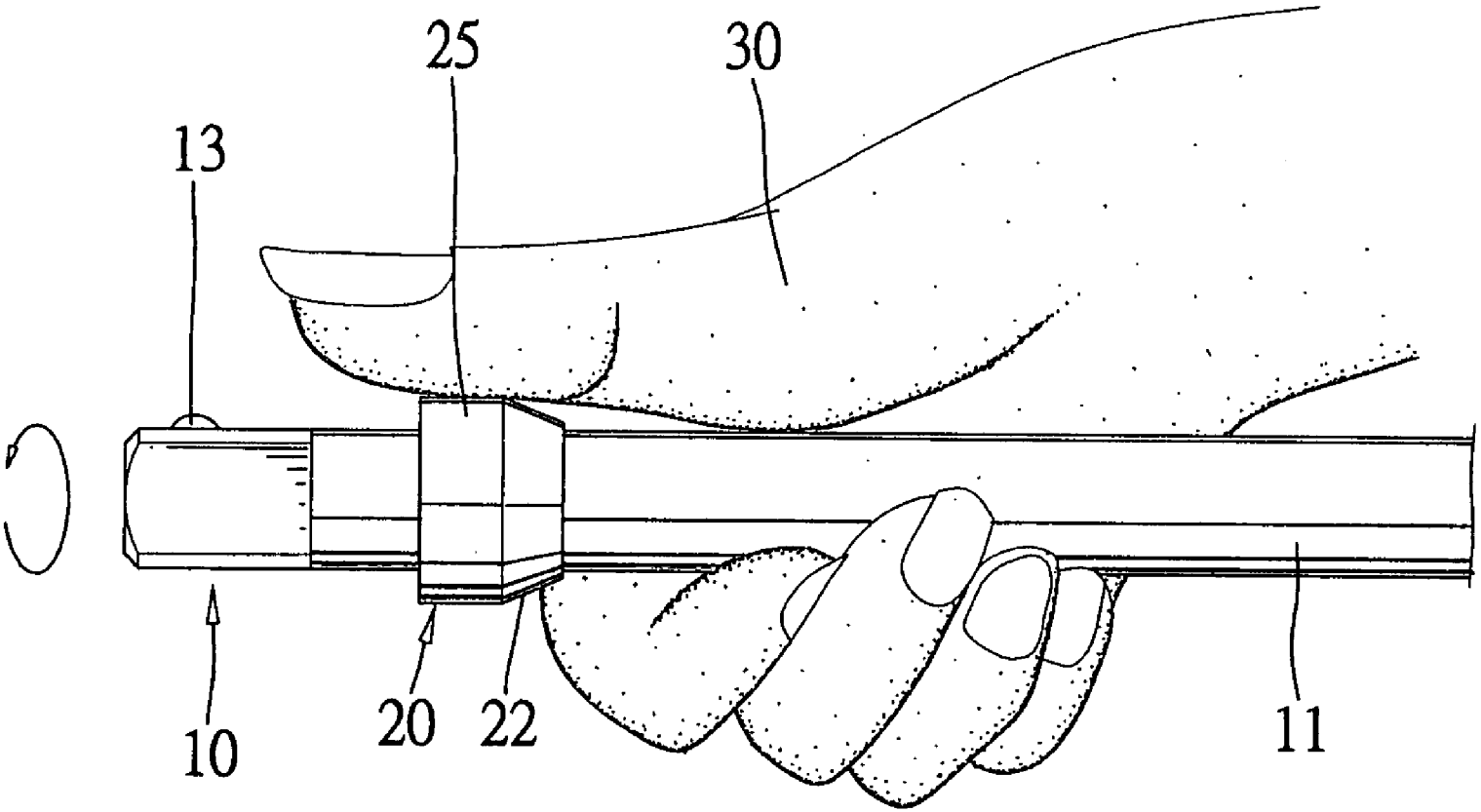
FIG. 6 is a side view of the protective sleeve and the extension bar of FIG. 2 held by a user's hand.

Referring to FIG. 6, the button 12 is surrounded by the protective sleeve 20. Hence, a user will not push the button 12 by accident. Moreover, the user will not have his or her hand hurt by the button 12.

Figure 7:
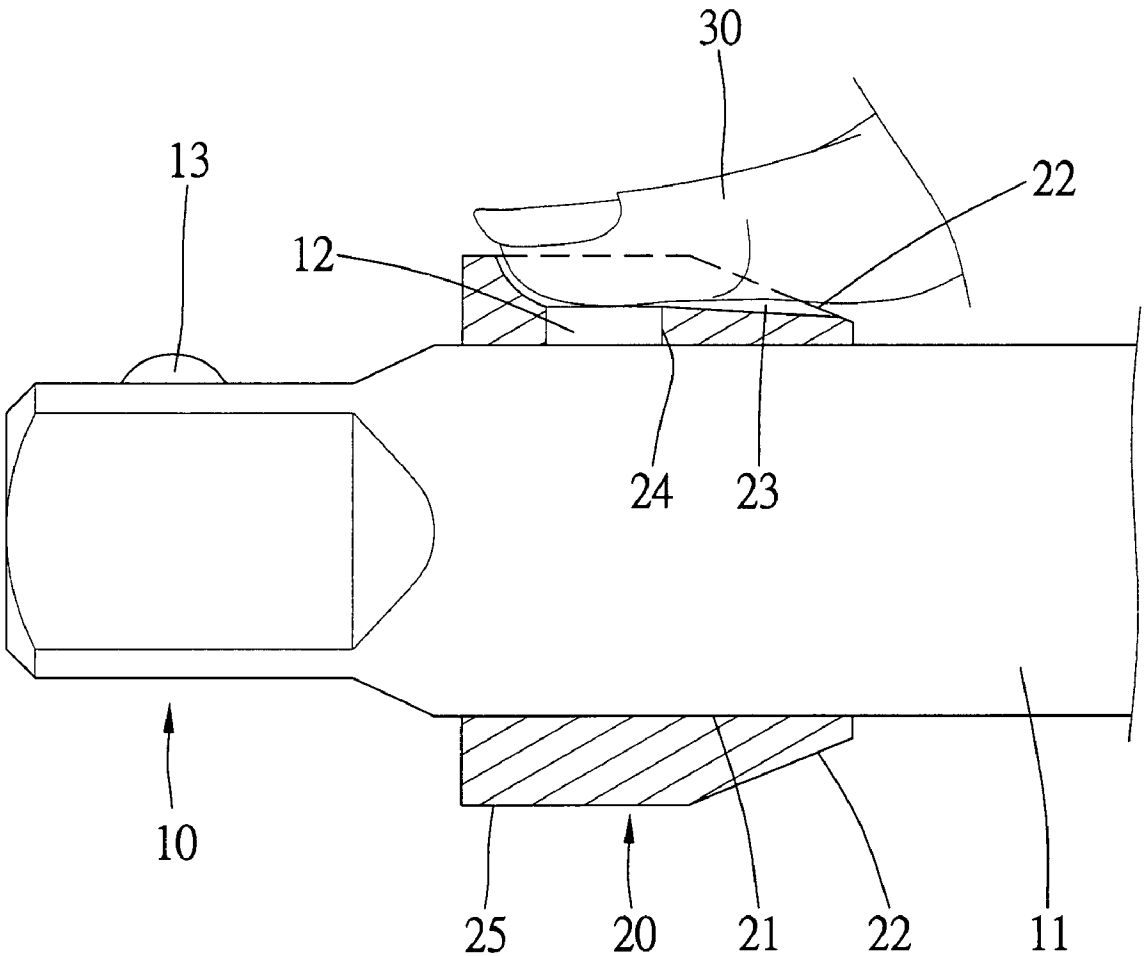
FIG. 7 is similar to FIG. 6 but shows the user's thumb pressing a button.

Referring to FIG. 7, the recess 23 encompasses the user's thumb 30 so that the user feels comfortable when pressing the button 12. The frustum-shaped portion 22 of the periphery of the protective sleeve 20 connects smoothly with the periphery of the shank 11 so that movement of the user's hand from the shank 11 to the protective sleeve 20 can be smooth and quick.

The present invention has been described through detailed illustration of the preferred embodiment. Those skilled in the art can derive variation from the preferred embodiment without departing from the scope of the present invention. Therefore, the preferred embodiment shall not limit the scope of the present invention defined in the claims.

The invention claimed is:

1. An assembly comprising, in combination:

a protective sleeve; and an extension bar comprising a detent and a button for controlling the detent, with the button having a first height extending radially from the extension bar and being pushable into the extension bar to a second height extending radially from the extension bar less than the first height, wherein the protective sleeve defines a hole and an aperture communicating with the hole, wherein the hole receives the extension bar when the aperture receives the button, with the protective sleeve defining a recess for receiving a user's finger, wherein the aperture is located within the recess, with the button extending into the recess at the first height, with the protective sleeve comprising a thickness extending radially from the extension bar and outside of the recess, with the thickness being greater than the first height of the button, with the protective sleeve comprising a periphery with a cylindrical portion and a frustum-shaped portion sloping from the cylindrical portion to an axial end, wherein the frustum-shaped portion of the periphery of the protective sleeve slopes to the periphery of the extension bar in the same direction that the protective sleeve is put on the extension bar, with the cylindrical portion including the thickness, with the recess formed in the cylindrical portion and the frustum-shaped portion and extending to a location in close proximity to the axial end of the frustum-shaped portion, with the cylindrical portion and the frustum-shaped portion each having an axial extent along the extension bar, with the axial extent of the frustum-shaped portion being greater than the thickness.

* * * * *